US008651601B2

(12) United States Patent
Sasaki

(10) Patent No.: US 8,651,601 B2
(45) Date of Patent: Feb. 18, 2014

(54) PRINTING APPARATUS

(75) Inventor: Tatsunori Sasaki, Kawasaki (JP)

(73) Assignee: Canon Kabushiki Kaisha, Tokyo (JP)

( * ) Notice: Subject to any disclaimer, the term of this patent is extended or adjusted under 35 U.S.C. 154(b) by 87 days.

(21) Appl. No.: 13/357,583

(22) Filed: Jan. 24, 2012

(65) Prior Publication Data

US 2012/0194580 A1 Aug. 2, 2012

(30) Foreign Application Priority Data

Jan. 31, 2011 (JP) ..... 2011-019141

(51) Int. Cl.
*B41J 29/38* (2006.01)

(52) U.S. Cl.
USPC ..... 347/5; 347/14; 347/19

(58) Field of Classification Search
USPC ..... 347/5, 9, 14, 19; 358/1.14, 1.15
See application file for complete search history.

(56) References Cited

U.S. PATENT DOCUMENTS 7,859,693 B2 * 12/2010 Ueno et al. ..... 358/1.14

FOREIGN PATENT DOCUMENTS

JP 2005-225175 A 8/2005
JP 2007-210144 A 8/2007

OTHER PUBLICATIONS

U.S. Appl. No. 13/421,765, filed Mar. 15, 2012. Applicant: Tatsunori Sasaki.

* cited by examiner

*Primary Examiner* — Juanita D Jackson
(74) *Attorney, Agent, or Firm* — Fitzpatrick, Cella, Harper & Scinto

(57) ABSTRACT

This invention relates to realization of a more efficient power-saving mode in a printing apparatus capable of connecting an extension board for function enhancement. When the printing apparatus connects an extension board including a CPU and memory, the CPU of the extension board receives information required to return to a normal operation mode from a controller unit, and stores the received information in the memory before transition from the normal operation mode to the power-saving mode. Then, the controller unit lowers an operation frequency of a CPU thereof, and stops power supply to respective units of the apparatus, which do not require any power supply. In the power-saving mode, the extension board monitors an elapse of a predetermined time period and reception of print data, thereby, even in the power-saving mode, normally returning to the normal operation mode after the elapse of the time period.

20 Claims, 8 Drawing Sheets

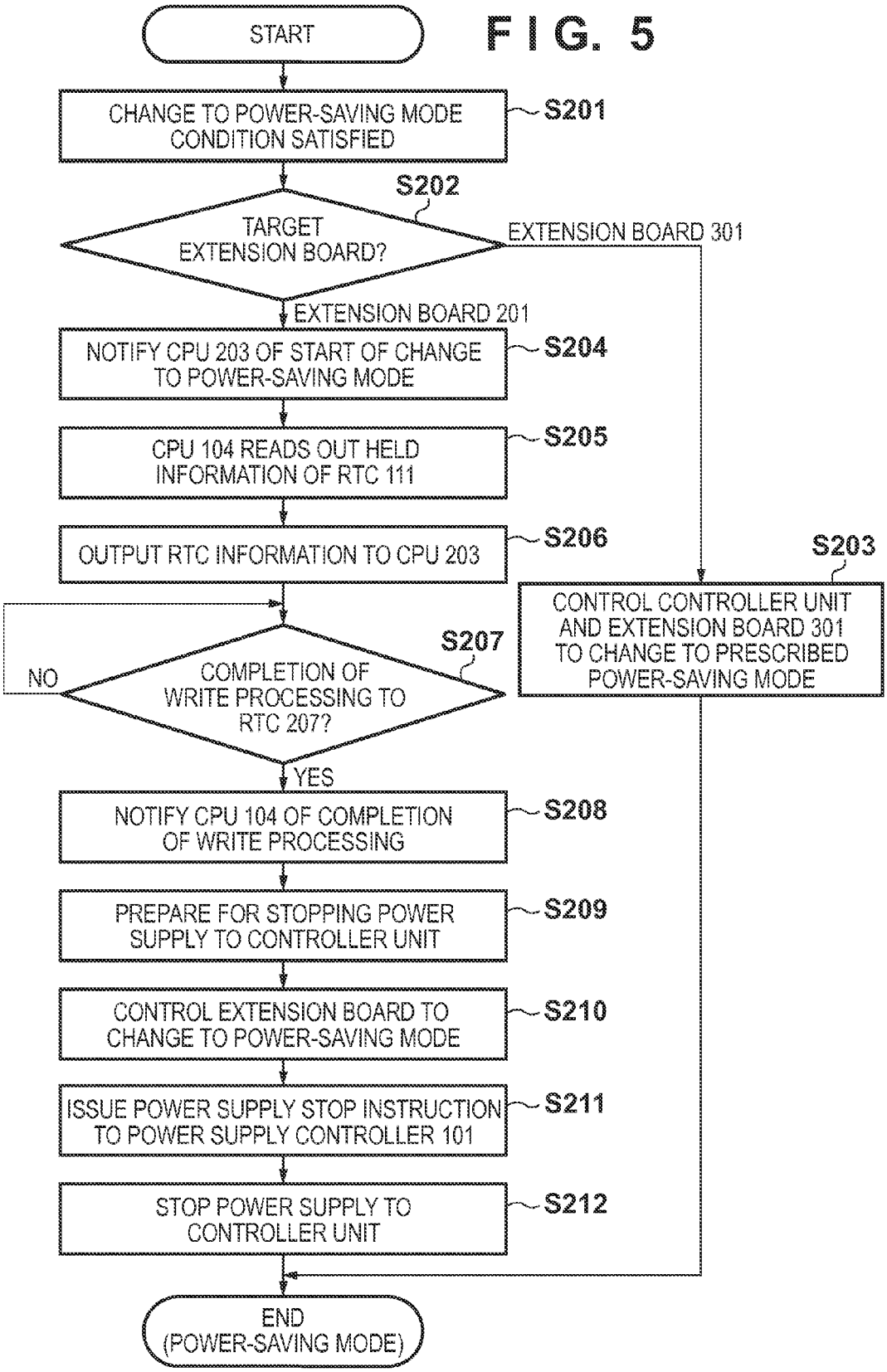
START
FIG. 5
CHANGE TO POWER-SAVING MODE CONDITION SATISFIED
S201
S202
TARGET EXTENSION BOARD?
EXTENSION BOARD 301
EXTENSION BOARD 201
NOTIFY CPU 203 OF START OF CHANGE TO POWER-SAVING MODE
S204
CPU 104 READS OUT HELD INFORMATION OF RTC 111
S205
OUTPUT RTC INFORMATION TO CPU 203
S206
S203
CONTROL CONTROLLER UNIT AND EXTENSION BOARD 301 TO CHANGE TO PRESCRIBED POWER-SAVING MODE
S207
NO
COMPLETION OF WRITE PROCESSING TO RTC 207?
YES
NOTIFY CPU 104 OF COMPLETION OF WRITE PROCESSING
S208
PREPARE FOR STOPPING POWER SUPPLY TO CONTROLLER UNIT
S209
CONTROL EXTENSION BOARD TO CHANGE TO POWER-SAVING MODE
S210
ISSUE POWER SUPPLY STOP INSTRUCTION TO POWER SUPPLY CONTROLLER 101
S211
STOP POWER SUPPLY TO CONTROLLER UNIT
S212
END (POWER-SAVING MODE)

PRINTING APPARATUS

BACKGROUND OF THE INVENTION

1. Field of the Invention

The present invention relates to a printing apparatus. Particularly, the present invention relates to a printing apparatus, which can selectively connect various extension boards to extend functions.

2. Description of the Related Art

Conventionally, a printing apparatus, which incorporates a CPU specialized to specific function processing independently of a CPU required to control the overall apparatus so as to extend functions, has been proposed.

For example, a controller board originally equipped in a printer has predetermined functions. Also, a printer, which implements operations as that having more advanced functions than the predetermined functions by mounting an extension CPU board, is available (see Japanese Patent Laid-Open No. 2007-210144). In the printer in which a CPU on the extension board and that on the controller board execute parallel processing to extend functions in this way, since the plurality of CPUs are concurrently driven, power consumption increases considerably.

On the other hand, nowadays, a requirement to reduce power consumption of an apparatus with consideration for environments has been increasing.

For this reason, in some printers, when a printer has not been used for a long time period, power is supplied to only minimum required functional blocks required to receive data from a host and to attain transition to a normal operation mode, and power supply and clock supply to unnecessary functional blocks are stopped, thereby reducing power consumption.

Also, the following proposal has been made (see Japanese Patent Laid-Open No. 2005-225175). That is, in this proposal, power consumption reduction execution methods are switched depending on whether or not an additional functional block connected to an extension slot is compatible with a power-saving mode, so as to reduce power consumption in the aforementioned printer which can extend functions using extension slots.

However, Japanese Patent Laid-Open No. 2005-225175 does not consider to entrust control on the extension board side and to stop power supply to the controller board itself, so as to attain a further reduction of power consumption in a power-saving mode.

An inkjet printer performs printing by supplying an ink stored in an ink supply source such as an ink cartridge to a printhead via an ink supply channel, and discharging ink droplets from nozzles of the printhead onto a print sheet. For this reason, when ink discharge operations from the nozzles of the printhead have not been performed for a long time period, volatile components are vaporized from the nozzles, thus causing troubles such as high viscosity of residual ink and entry of air bubbles from the nozzles to the interior.

Hence, an ink suction mechanism required to suck and externally eject inks from the nozzles of the printhead is arranged in the inkjet printer, so as to suck inks from the respective nozzles of the printhead, thus providing a cleaning mechanism of the printhead to always maintain an appropriate printable state. With this mechanism, processing for recovering the performance of the printhead to a given level (head recovery processing) is periodically executed. Such head recovery processing has to be executed every time a predetermined time period elapses.

However, in the inkjet printer which can extend functions using the extension boards, as described above, a timer is provided to the controller board in consideration of a case in which no function is extended, and the head recovery processing is executed in response to an interrupt signal, which is output after an elapse of a prescribed time period. Therefore, the CPU on the controller board has to be always ready to receive the interrupt signal from the timer. Even when a CPU and timer are equipped on the extension board, an arrangement that entrusts the control on the extension board side, and stops power supply to the controller board cannot be adopted. For this reason, the controller board cannot attain a power-saving mode, and does not suffice to reduce power consumption.

SUMMARY OF THE INVENTION

Accordingly, the present invention is conceived as a response to the above-described disadvantages of the conventional art.

For example, a printing apparatus according to this invention are capable of attaining more efficient power savings in a printing apparatus which can connect an extension board to extend functions.

According to one aspect of the present invention, there is provided a printing apparatus comprising: a power supply unit; a power supply control unit configured to control power supply to respective units included in the printing apparatus, from the power supply unit; a printing unit configured to print at a normal operation mode; and a controller unit, including: an interface unit for connecting to an extension board which includes a communication unit for communicating with an external; a first controller for performing image processing on image data transferred from the extension board via the interface unit and instructing the power supply control unit; and a first timer unit, wherein, in a case where the extension board is a first extension board to which no control unit or timer is provided, the first controller instructs a first timer unit to time until a predetermined time period elapses, instructs the power supply control unit to stop supplying power to all units other than the first extension board, the first controller, and the first timer, and causes the printing apparatus to change from the normal operation mode to a first power-saving mode, in a case where the extension board is a second extension board to which a second control unit and second timer are provided, the second controller instructs the second timer to time until the predetermined time period elapses, instructs the power supply control unit to stop supplying power to all units other than the second control unit and the second timer, and causes the printing apparatus to change from the normal operation mode to a second power-saving mode, in a case where the predetermined time period elapsed since the printing apparatus changed from the normal operation mode to the first power-saving mode, the first controller instructs the power supply control unit to resume the power supply, and causes the printing apparatus to return from the first power-saving mode to the normal operation mode, and in a case where the predetermined time period elapsed since the printing apparatus changed from the normal operation mode to the second power-saving mode, the second controller instructs the power supply control unit to resume the power supply, and causes the printing apparatus to return from the second power-saving mode to the normal operation mode.

The invention is particularly advantageous since power supply control to respective units of the apparatus is changed upon transition to a power-saving mode according to a type of a connected extension board, thus attaining more efficient power savings.

Further features of the present invention will become apparent from the following description of exemplary embodiments (with reference to the attached drawings).

BRIEF DESCRIPTION OF THE DRAWINGS

FIG. 5 is a flowchart showing power supply control when the printing apparatus changes to a power-saving mode.

DESCRIPTION OF THE EMBODIMENTS

An Exemplary embodiment of the present invention will now be described in detail in accordance with the accompanying drawings. Note that arrangements disclosed by the following embodiments are merely illustrative examples, and the present invention is not limited to the illustrated arrangements.

In this specification, the terms "print" and "printing" not only include the formation of significant information such as characters and graphics, but also broadly includes the formation of images, figures, patterns, and the like on a printing medium, or the processing of the medium, regardless of whether they are significant or insignificant and whether they are so visualized as to be visually perceivable by humans.

Also, the term "printing medium" not only includes a paper sheet used in common printing apparatuses, but also broadly includes materials, such as cloth, a plastic film, a metal plate, glass, ceramics, wood, and leather, capable of accepting ink.

Furthermore, the term "ink" (to be also referred to as a "liquid" hereinafter) should be extensively interpreted similar to the definition of "print" described above. That is, "ink" includes a liquid which, when applied onto a printing medium, can form images, figures, patterns, and the like, can process the printing medium, and can process ink. The process of ink includes, for example, solidifying or insolubilizing a coloring agent contained in ink applied to the printing medium.

Moreover, "printing element" (to be also referred to as "nozzle") generally represents an ink orifice, an ink channel which communicates with it, and an element which generates energy used to discharge ink unless otherwise specified.

Figure 1A:
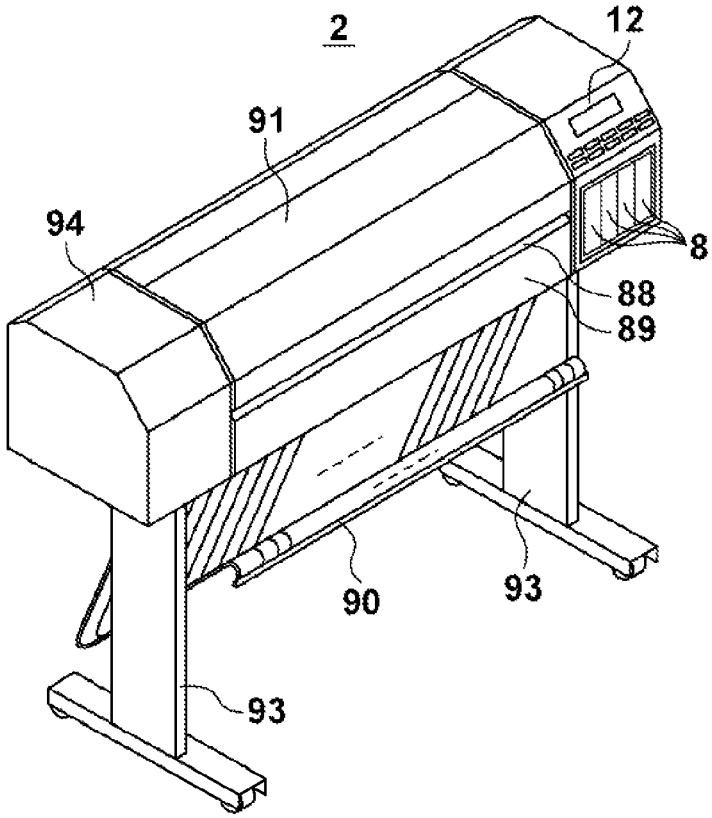
FIGS. 1A and 1B are perspective views showing principal mechanism parts of an inkjet printing apparatus as a representative embodiment of the present invention.
Figure 1B:
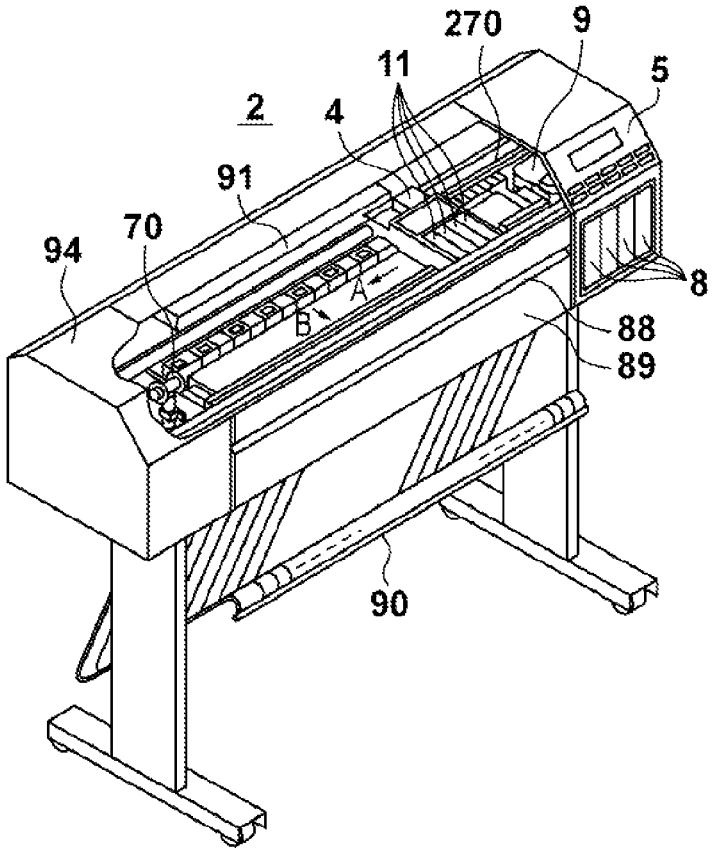

FIGS. 1A and 1B are perspective views showing the outer appearance of an inkjet printing apparatus (to be referred to as a printing apparatus hereinafter), which uses print media of A0 and B0 sizes, as a representative embodiment of the present invention. FIG. 1B is a perspective view showing a state in which an upper cover of the printing apparatus shown in FIG. 1A is detached.

As shown in FIG. 1A, a manual insertion port 88 is provided to the front surface of a printing apparatus 2, and a roll paper cassette 89 which is free to be open or close with respect to the front surface is provided to a position below the manual insertion port 88. A printing medium such as a print sheet is supplied from the manual insertion port 88 or the roll paper cassette 89 to the interior of the printing apparatus. The printing apparatus 2 includes an apparatus main body 94 which is supported by two leg portions 93, a stacker 90 which stacks discharged print sheets, and a transparent upper cover 91 which allows to see through the interior and is free to open/close. Also, an operation panel 12, ink supply unit, and ink tanks are disposed on the right side of the apparatus main body 94.

As shown in FIG. 1B, the printing apparatus 2 further includes a conveyance roller 70 required to convey a printing medium in a direction of an arrow B (sub-scan direction), and a carriage 4 which is guided and supported to be reciprocal in a widthwise direction (a direction of an arrow A or main scan direction) of a printing medium. The printing apparatus 2 further includes a carriage motor (not shown) and a carriage belt (to be referred to as a belt hereinafter) 270, which are used to reciprocally move the carriage 4 in the direction of the arrow A, and a printhead 11 mounted on the carriage 4. Also, the printing apparatus 2 includes a suction ink recovery unit 9 which supplies inks and eliminates ink discharge failures due to clogging of orifice of the printhead 11. The operation panel 12 includes user instruction input keys 5.

In case of this printing apparatus, an inkjet printhead (to be referred to as a printhead hereinafter) 11, which includes four heads in correspondence with four color inks to attain color printing on a printing medium, is mounted on the carriage 4. That is, the printhead 11 is configured by, for example, a K (black) head used to discharge a K ink, a C (cyan) head used to discharge a C ink, an M (magenta) head used to discharge an M ink, and a Y (yellow) head used to discharge a Y ink.

When printing is made on a printing medium by the above arrangement, a printing medium is conveyed by the conveyance roller 70 to a predetermined print start position. After that, an operation for scanning the printhead 11 in the main scan direction by the carriage 4, and an operation for conveying the printing medium in the sub-scan direction by the conveyance roller 70 are repeated to attain printing on the entire printing medium.

That is, when the carriage 4 is moved in the direction of the arrow A shown in FIG. 1B by the belt 270 and carriage motor (not shown), printing is performed on the printing medium. When the carriage 4 is returned to a position (home position) before scanning, the printing medium is conveyed in the sub-scan direction (the direction of the arrow B shown in FIG. 1B) by the conveyance roller, and the carriage is then scanned again in the direction of the arrow A in FIG. 1B. In this manner, images, characters, and the like are printed on the printing medium. When the aforementioned operations are further repeated to end printing for one printing medium, that printing medium is discharged into the stacker 90, thus completing printing for one sheet.

Figure 2:
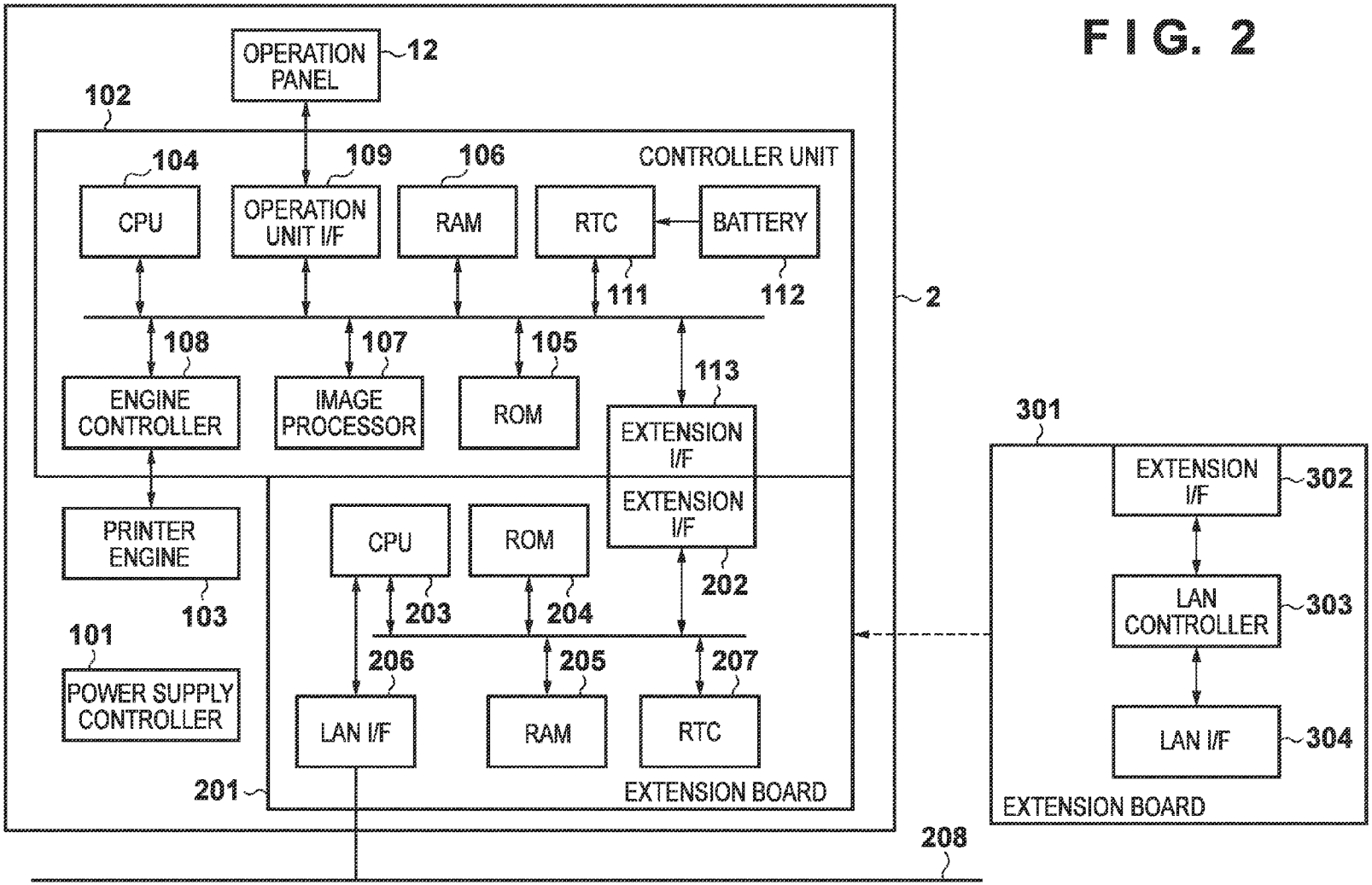
FIG. 2 is a block diagram showing the control arrangement of the printing apparatus shown in FIGS. 1A and 1B.

FIG. 2 is a block diagram showing the control arrangement of the printing apparatus shown in FIGS. 1A and 1B.

As shown in FIG. 2, the printing apparatus 2 is basically configured by a power supply controller 101, controller unit 102, and printer engine 103, and the operation panel 12 is connected to the controller unit 102. Normally, a CPU 104 of the controller unit 102 reads out a system control program stored in a ROM 105, expands the readout program on a RAM 106, and executes that program, thereby controlling the overall printing apparatus 2. The RAM 106 is also used as a buffer memory at the time of reception of image data.

An image processor 107 executes color space processing, gamma correction processing, quantization processing based on an error diffusion method, and the like for bitmapped image data (multi-valued data or binary data) temporarily stored in the RAM 106 in accordance with an instruction from the CPU 104, thereby generating binary data, which can be processed by the printer engine 103. The printer engine 103 is controlled by an engine controller 108, and binary image data generated by the processing in the image processor 107 is transferred to the printer engine 103.

The printer engine 103 prints an image by discharging inks onto a printing medium, as described above with reference to FIGS. 1A and 1B. The printer engine 103 includes various error detection sensors (not shown), a carriage motor (not shown) serving as a driving source for the carriage, a conveyance motor (not shown) serving as a driving source for the conveyance roller, and the printhead 11, and executes their operations under the control of the engine controller 108.

The operation panel 12 is connected to the controller unit 102 via an operation unit interface (I/F) 109, which outputs image data to be displayed on an LCD of the operation panel 12 to the operation panel 12. The operation unit I/F 109 plays a role in transferring information, which is input by the user using the input keys 5 on the operation panel 12, to the CPU 104.

A real-time clock (to be abbreviated as an RTC hereinafter) 111 has a timer function, and includes a signal line used to issue, to the CPU 104, date/time information required for the printing apparatus 2, and an interrupt signal as an execution trigger of, for example, the head recovery processing to be executed at predetermined time intervals. This interrupt signal is generated by referring to an interrupt timer setting date and time set in the RTC 111 and by detecting an elapse of the setting date and time, thus interrupting the CPU 104.

To the RTC 111, a battery 112 is connected independently of a power source used in the apparatus. Even when power supply to the RTC 111 is stopped, the battery 112 allows the RTC 111 to continue its operation and to store and hold the date/time information and interrupt timer setting date and time.

Note that the controller unit 102 includes an extension I/F 113, which can connect an extension board 201 used to extend functions of the printing apparatus 2.

In this embodiment, the extension board 201 is connected to the extension I/F 113 of the controller unit 102 via an extension I/F 202.

The extension board 201 is configured by a CPU 203, ROM 204, RAM 205, LAN interface (I/F) 206, and RTC 207, and is connected to a host computer via a LAN 208 to receive job data and to transmit status information of the printing apparatus 2. In this embodiment, the LAN 208 and LAN I/F 206 are configured to conform to the Ethernet® interface specification. The CPU 203 integrates a controller of the LAN I/F 206. Thus, the CPU 203 functions as a LAN controller for communicating with the host computer, and controls communications with the host computer.

Also, in this embodiment, the CPU 203 generates and renders a display list as intermediate data from PDL (Page Description Language) data received from the host computer by expanding a program stored in the ROM 204 onto the RAM 205 and executing that program. The rendered bitmapped image data (multi-valued data or binary data) is output to the controller unit 102 via the extension I/F 202. For this purpose, the ROM 204 stores a control program of the extension board 201 and a conversion program used to process PDL data. The RAM 205 is used as a buffer memory at the time of reception of job data, and also as a buffer memory for temporarily storing various control data to be exchanged with the host computer. Note that the data processing performance of the CPU 203 is higher than that of the CPU 104, and the CPU 203 is capable of handling data (multi-valued data or binary data) other than PDL data. Thus, in a case where the CPU 203 receives data other than PDL data, the CPU 203 performs data processing according to the data format, and outputs the processed data to the control unit 102 via the extension I/F 202.

The RTC 207 has a timer function as in the RTC 111, and can hold a date and time and an interrupt timer setting date and time as information. An interrupt signal from the RTC 207 is output to the CPU 203.

Note that in this embodiment, the extension board 201 is used to perform high speed processing of PDL data as its principal purpose. When no high speed PDL data processing is required, provided that the CPU 104 performs PDL data processing, an extension board 301 can be connected exclusively with the extension board 201.

The extension board 301 does not include any CPU, and is configured by an extension I/F 302, LAN controller (communication unit) 303 for communicating with the host computer via the LAN 208, and LAN I/F 304. The extension I/F 302 can be connected to the extension I/F 113 of the controller unit 102, and the LAN I/F 304 can be connected to the LAN 208. When the extension board 301 is connected to the printing apparatus 2, the CPU 104 controls the LAN controller 303. For this reason, the ROM 105 pre-stores a control program for the LAN controller 303. At the activation timing of the printing apparatus 2, a connected extension board is identified to determine whether or not its control program is to be expanded.

Note that job data received via the LAN I/F 304 is stored in the RAM 106 in accordance with an instruction from the CPU 104. In a case where the extension board 301 is connected to the controller unit 102, the controller unit 102 receives PDL data from the host computer. In this case, the CPU 104 performs generation of a display list from PDL data and rendering.

The printing apparatus 2 has the power supply controller 101 for power supply management, and executes power supply and supply stop operations for respective functional blocks in a power-saving mode in accordance with an instruction from the CPU 104 or 203. Although not shown in FIG. 2, GPIO (general-purpose I/O) port signals from the CPUs 104 and 203 are connected to the power supply controller 101, which executes power supply control using these signals as control signals.

Figure 3:
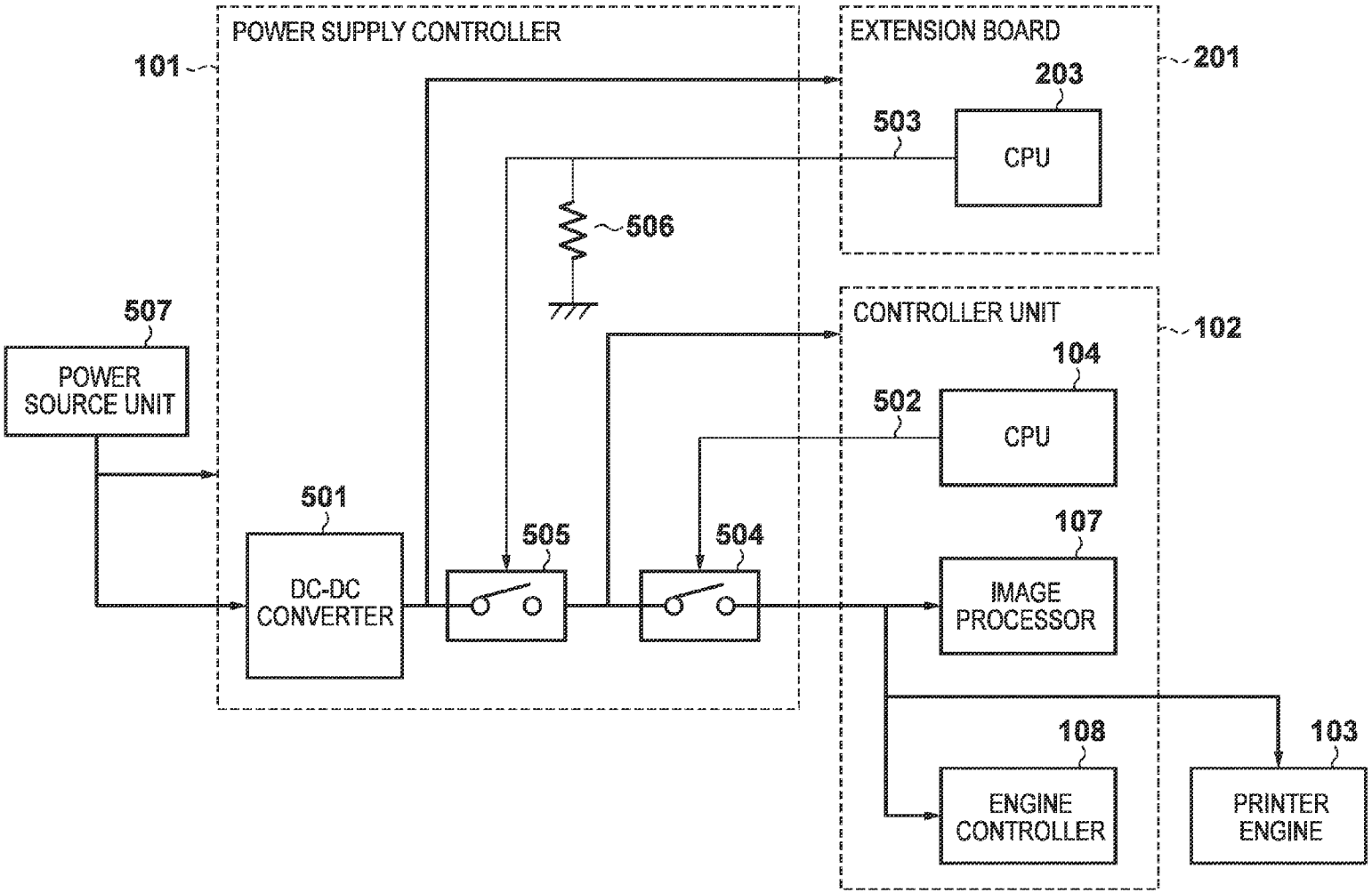
FIG. 3 is a block diagram showing the detailed arrangement of a power supply controller 101.

FIG. 3 is a block diagram showing the detailed arrangement of the power supply controller 101.

As shown in FIG. 3, the power supply controller 101 is configured by a DC-DC converter 501, and switches 504 and 505, and switches the switches 504 and 505 using a port signal 502 from the CPU 104 and a port signal 503 from the CPU 203 as control signals.

Note that each of the switches 504 and 505 is configured by a non-contact type switch circuit using an FET transistor and digital transistor as a detailed arrangement. Also, the power supply controller 101 operates to always supply power even in a power-saving mode.

Furthermore, the switches 504 and 505 are opened, that is, in a power supply stop state in a "High" state in which voltages are applied to the port signals 502 and 503 from the CPUs 104 and 203, and are closed, that is, in a power supply state in a "Low" state. A pull-down resistor 506 is connected to the port signal 503. When the extension board 301 is connected, one end of the port signal 503 is set in an open state without any connection destination. On the other hand, since the switch 505 always receives "Low", it is set in a closed state, that is, a power supply state.

A power source unit 507 incorporates an AC-DC converter (not shown) for converting a power used in the printing apparatus 2 from an alternating current power (AC) to a direct current power (DC), and generates all powers used in the printing apparatus. Supplementarily explaining about FIG. 2, a battery 112 is provided in the RTC 111 so as to accurately time even when power supply from the power source unit 507 stops. Therefore, if the printing apparatus is not required to accurately time even when power supply from the power source unit 507 stops, the battery may be eliminated from the printing apparatus.

When a transition condition to the power-saving mode is satisfied in a normal operation mode, the printing apparatus 2 instructs the power supply controller 101 to stop power supply to functional blocks using the port signal from the CPU 104 or 203. Likewise, when a return condition to the normal operation mode is satisfied in the power-saving mode, the printing apparatus 2 instructs the power supply controller 101 to restart power supply using the port signal from the CPU 104 or 203.

In this embodiment, when a predetermined time period has elapsed while the printing apparatus 2 is left unused, the apparatus changes to the power-saving mode in response to an instruction from the CPU 104. After changing to the power-saving mode, the printing apparatus 2 returns to the normal operation mode in response to an instruction from the CPU 104 or 203 upon reception of job data (print data) from the host computer via the LAN I/F 206 or 304.

Also, the printing apparatus 2 returns to the normal operation mode in response to an interrupt signal from the RTC 111 or 207 when the interrupt timer setting date and time have elapsed. However, these transition control to the power-saving mode and return control to the normal operation mode vary depending on extension boards connected to the extension I/F 113. In the normal operation mode, the printhead can discharge inks to attain a printing operation. In the power-saving mode, the printing apparatus is set in a standby state in which it does not execute any printing operation, stops execution of functions other than the reception monitoring function of printing data and the timer function, and stops power supply to the respective stopped units of the apparatus.

Figure 4A:
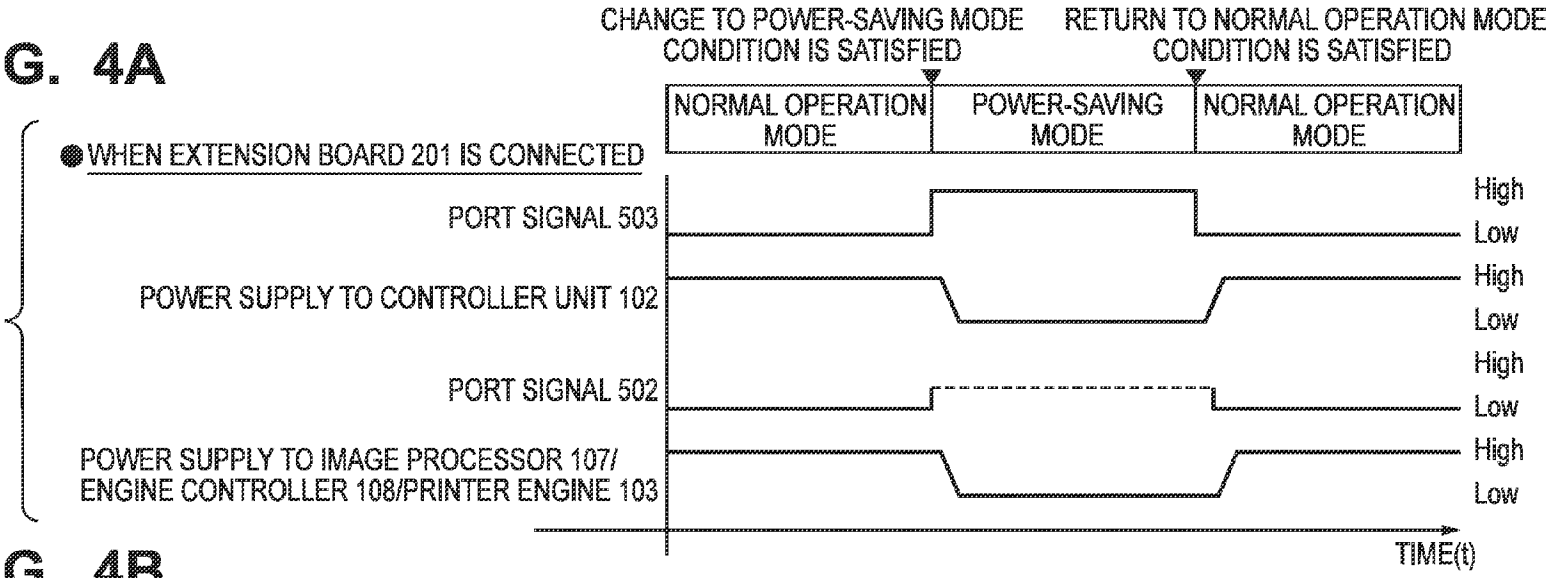
FIGS. 4A and 4B are time charts showing a port signal from a CPU 104 or 203 and a power supply/stop relationship to functional blocks when an extension board 201 or 301 is connected.
Figure 4B:
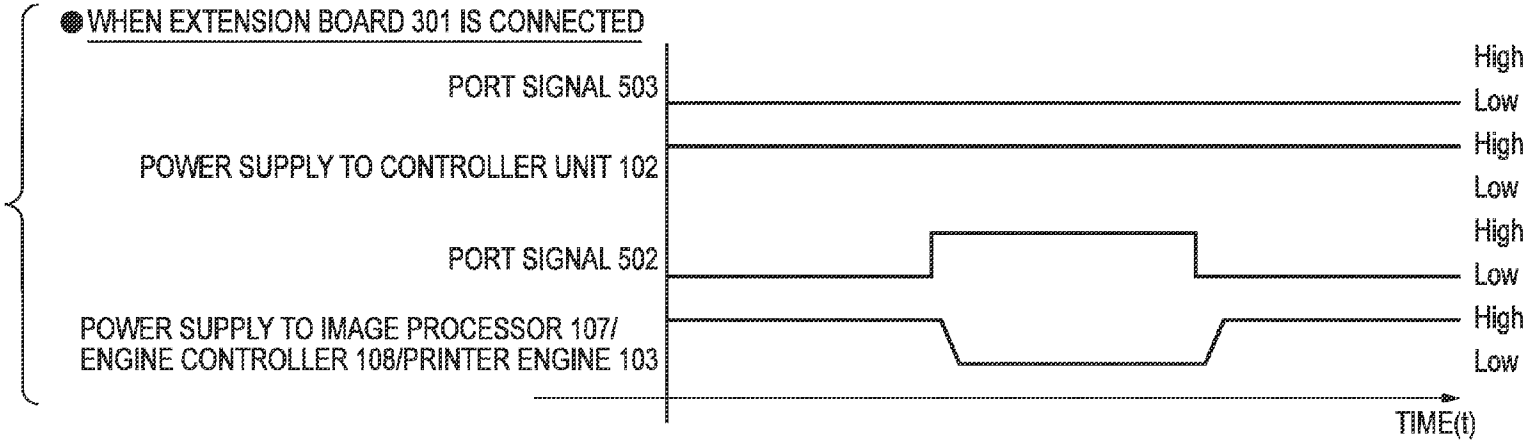

FIGS. 4A and 4B show the port signal from the CPU 104 or 203 and the power supply/stop relationship to functional blocks when the extension board 201 or 301 is connected. FIG. 4A shows the port signal from the CPU 203 and the power supply/stop relationship to functional blocks when the extension board 201 is connected. FIG. 4B shows the port signal from the CPU 104 and the power supply/stop relationship to functional blocks when the extension board 301 is connected.

As shown in FIGS. 4A and 4B, the printing apparatus 2 controls the power supply controller 101 to execute power control at the time of change from the normal operation mode to the power-saving mode and at the time of return from the power-saving mode to the normal operation mode.

As can be seen from the above configuration, the controller unit 102 consumes much power to control many functions of the respective units of the apparatus. On the other hand, since the extension board 201 or 301 operates to implement its own function, power consumption is much smaller than the controller unit 102.

The power supply control upon transition to the power-saving mode and upon returning to the normal operation mode, which control is executed by the printing apparatus 2 with the above arrangement, will be described below with reference to the flowcharts.

First Embodiment

<Transition to Power-Saving Mode>

FIG. 5 is a flowchart showing the power supply control executed when the printing apparatus 2 changes to the power-saving mode.

When the transition condition to the power-saving mode is satisfied in step S201, transition processing to the power-saving mode is started. In this case, when the CPU 104 identifies that reception of job data via the LAN I/F 206 and user operations using the operation panel 12 have not been made during a prescribed time period, it starts the transition processing to the power-saving mode.

In step S202, the CPU 104 discriminates a type of an extension board connected to the extension I/F 113 of the controller unit 102.

If the connected extension board is the extension board 301 (first extension board) which does not incorporate any CPU and RTC, the process advances to step S203, and the CPU 104 controls the LAN controller 303 to change to the power-saving mode in which the LAN controller 303 can identify only data reception. Next, the CPU 104 instructs the power supply controller 101 to stop power supply to the image processor 107, engine controller 108, and printer engine 103, which are unnecessary functional blocks in the power-saving mode. In response to this instruction, the power supply controller 101 supplies power to only the CPU 104, the RAM 106 and the LAN controller 303, while the RTC 111 is power-supplied from the battery 112. In a case where the battery 112 is not provided in the controller unit, the power supply controller 101 further supplies power to the RTC 111. Finally, the CPU 104 controls the RAM 106 to change to a self-refresh mode in which the RAM 106 can hold data in a low-power consumption state.

Then, when the power supply controller 101 stops power supply to the designated functional blocks, and the RAM 106 changes to the self-refresh mode, the printing apparatus 2 completes transition to the power-saving mode.

By contrast, if the connected extension board is the extension board 201 (second extension board) which has the CPU and RTC, the process advances to step S204, and the CPU 104 notifies the CPU 203 of the start of the transition processing to the power-saving mode. In step S205, the CPU 104 reads out held information required to return to the normal operation mode from an internal storage area of the RTC 111. In step S206, the CPU 104 outputs the held information read out from the RTC 111 to the CPU 203 via the extension I/Fs 113 and 202. In step S207, the CPU 104 waits until the CPU 203 completes write processing of information in a storage area of the RTC 207.

After that in step S208, the CPU 203 is set in a reception waiting state of information to be written into the RTC 207 upon reception of the transition start notice to the power-saving mode received in step S204. Then, after reception of the information and write processing in the storage area of the RTC 207 are complete, the CPU 203 notifies the CPU 104 of completion of the write processing.

In step S209, upon reception of the completion notice from the CPU 203, the CPU 104 disconnects a link of the extension I/Fs, and saves data, which are required to be held, in the RAM 106 in the ROM 105, to prepare for stopping of power supply to the controller unit 102. Furthermore, in step S210, after recognition of the link disconnection of the extension I/Fs, the CPU 203 controls the internal LAN controller to change to the power-saving mode in which the internal LAN controller can identify only data reception. Also, the CPU 203 itself lowers its operation frequency, and controls the RAM 205 to change to a self-refresh mode in which the RAM 205 can hold data in a low-power consumption state, thereby setting the whole extension board 201 in the power-saving mode. Therefore, the power supply controller 101 supplies power to only the CPU 203, the RAM 205, and the RTC 207.

Finally, in step S211, the CPU 203 instructs the power supply controller 101 to stop power supply to the printer engine 103 and controller unit 102. In step S212, the power supply controller 101 stops power supply. In this way, the printing apparatus 2 changes to the power-saving mode.

With the aforementioned sequence, the printing apparatus 2 can implement the optimal power-saving mode according to the types of the connected extension boards.

<Return to Normal Operation Mode>

The power supply control upon returning from the power-saving mode to the normal operation mode will be described below with reference to the flowchart.

(1) When Extension Board 301 is Connected

Figure 6:
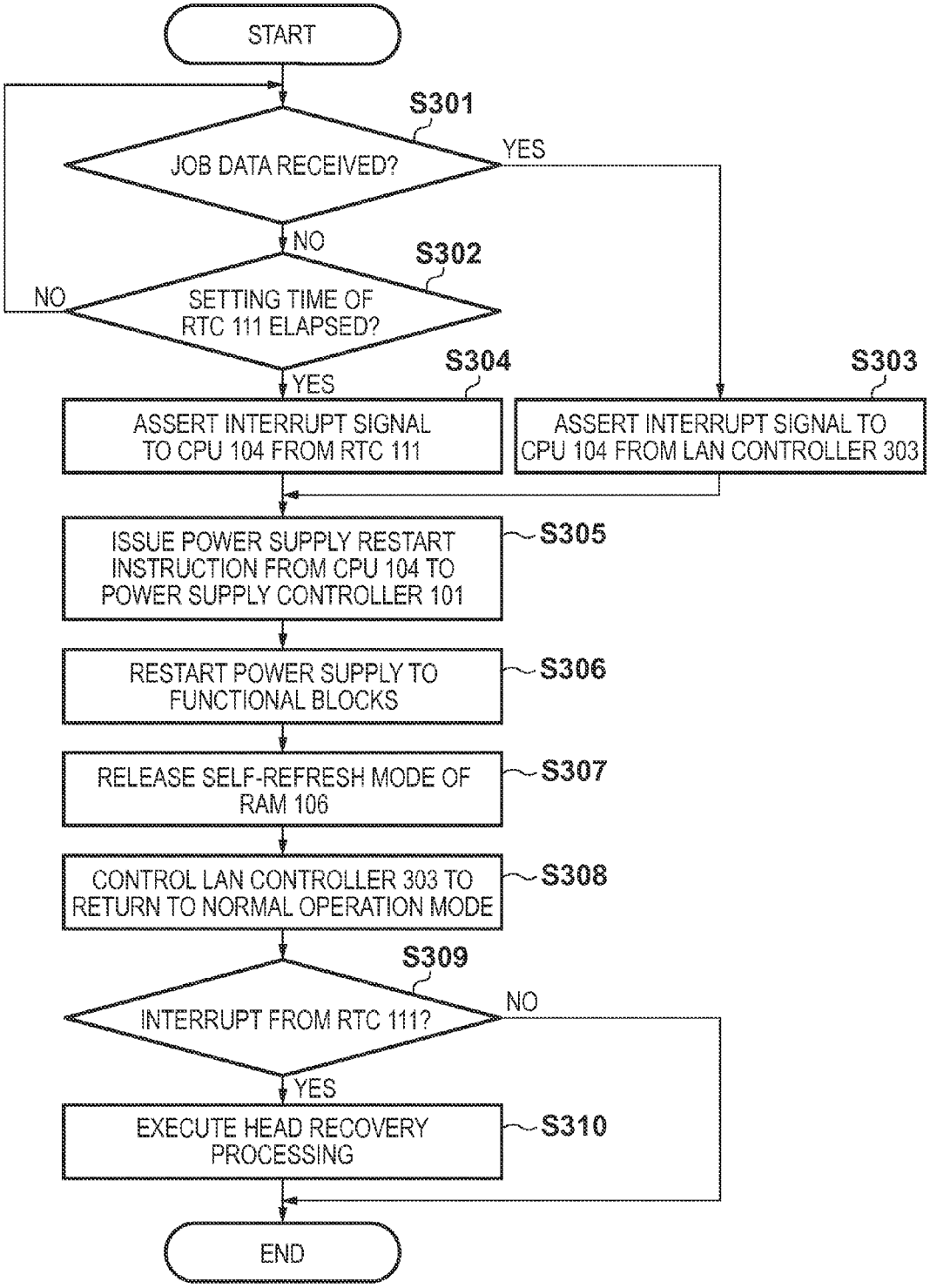
FIG. 6 is a flowchart showing power supply control upon returning from the power-saving mode to a normal operation mode when the extension board 301 is connected.

FIG. 6 is a flowchart showing the power supply control executed upon returning from the power-saving mode to the normal operation mode when the extension board 301 is connected.

The printing apparatus 2 checks in step S301 whether or not job data is received from the LAN I/F 304 after transition to the power-saving mode, and in step S302 whether or not a time has elapsed to reach a setting date and time (setting time) set in the storage area in the RTC 111. In this case, the printing apparatus 2 continuously maintains the power-saving mode until step S301 or S302 is satisfied.

If job data reception from the host computer is recognized in step S301, the process advances to step S303, and the LAN controller 303 asserts an interrupt signal to the CPU 104. After that, the process advances to step S305. On the other hand, if the time measured by the RTC has elapsed to reach the interrupt timer setting date and time set in the RTC 111 in step S302, the process advances to step S304, and the RTC 111 asserts an interrupt signal to the CPU 104. After that, the process advances to step S305.

Upon reception of the interrupt signal, the CPU 104 instructs the power supply controller 101 to restart power supply in step S305. Upon reception of that instruction, the power supply controller 101 restarts power supply to the functional blocks, to which power supply was stopped upon transition to the power-saving mode, in step S306.

In step S307, the CPU 104 controls the RAM 106 to return from the self-refresh mode to the normal operation mode which allows data read/write accesses. In step S308, the CPU 104 controls the LAN controller 303 to return to the normal operation mode in which the controller 303 can receive job data.

The CPU 104 discriminates in step S309 whether or not the interrupt signal from the RTC 111 is asserted. If it is discriminated that the interrupt signal from the RTC 111 is asserted, the process advances to step S310, and the CPU 104 executes predetermined processing such as the head recovery processing. After that, the CPU 104 issues an interrupt clear instruction to the RTC 111, and returns to the normal operation mode, thus ending the processing. On the other hand, if it is discriminated that the interrupt signal from the RTC 111 is not asserted in step S309, the CPU 104 determines that the interrupt signal is that from the LAN controller 303, thus ending the processing. In this way, the printing apparatus 2 returns to a normal printable state.

Note that in this embodiment, when the interrupt signal from the RTC 111 and that from the LAN controller 303 are concurrently asserted, the CPU 104 gives priority to the predetermined processing in response to the interrupt signal from the RTC 111.

(2) When Extension Board 201 is Connected

Figure 7:
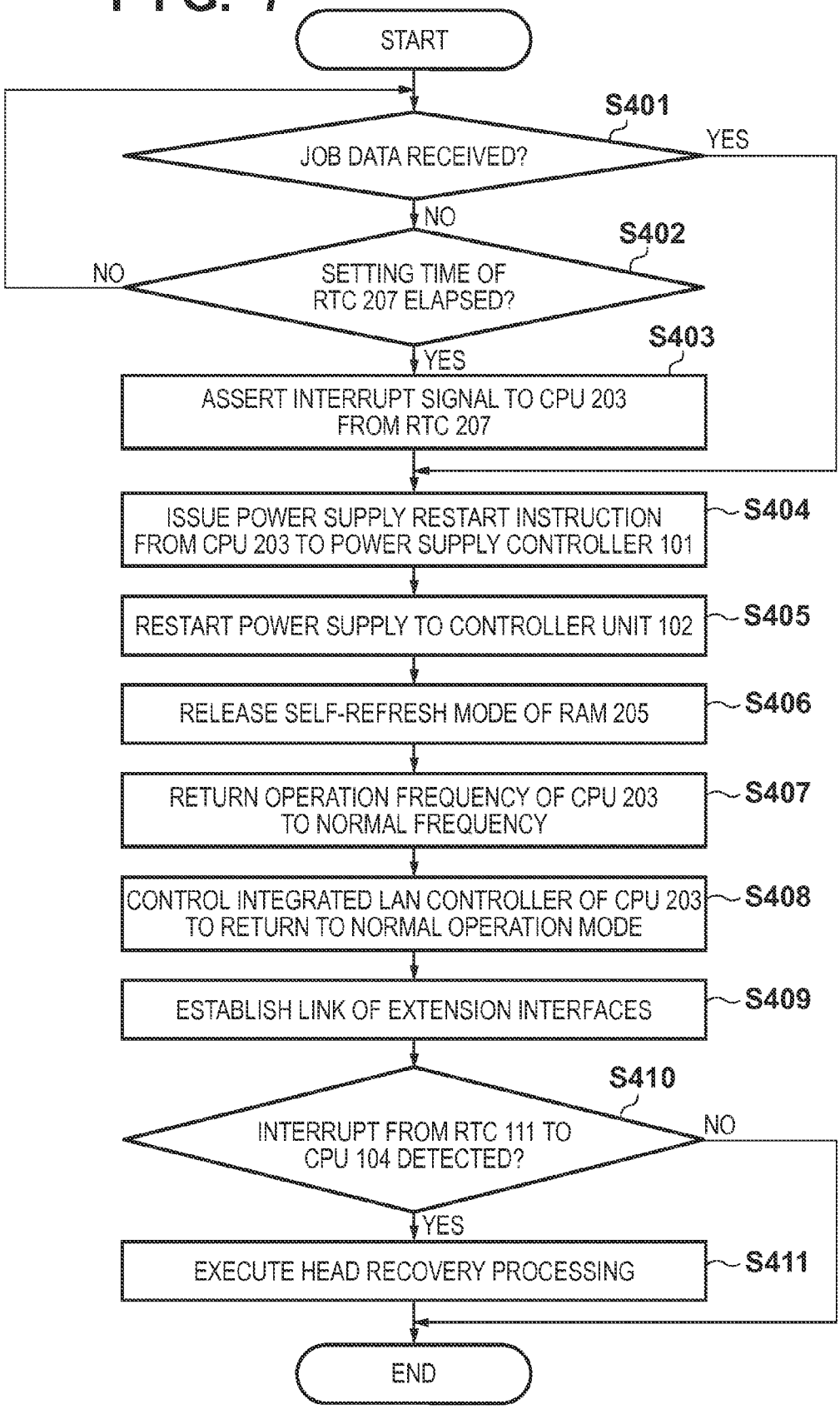
FIG. 7 is a flowchart showing power supply control according to the first embodiment upon returning from the power-saving mode to the normal operation mode when the extension board 201 is connected.

FIG. 7 is a flowchart showing the power supply control executed upon returning from the power-saving mode to the normal operation mode when the extension board 201 is connected.

As in the connection of the extension board 301, the printing apparatus 2 checks in step S401 whether or not job data is received from the LAN interface 206, and in step S402 whether or not a time has elapsed to reach a date and time set in the storage area in the RTC 207. In this case, the printing apparatus 2 continuously maintains the power-saving mode until step S401 or S402 is satisfied. Note that the RTC 207 is not that of the controller unit 102 but that of the extension board 201.

If job data is received from the host computer in step S401, the LAN controller integrated in the CPU 203 discriminates data reception. For this reason, the CPU 203 can also concurrently identify data reception. Therefore, in this case, the process jumps to step S404. If the date and time measured by the RTC have elapsed to reach the interrupt timer setting date and time (setting time) set in the RTC 207 in step S402, the process advances to step S403, and the RTC 207 asserts an interrupt signal to the CPU 203.

In step S404, the CPU 203, which received the interrupt signal, instructs the power supply controller 101 to restart power supply. Upon reception of this instruction, the power supply controller 101 restarts power supply to the controller unit 102, to which power supply was stopped at the time of transition to the power-saving mode, in step S405.

In step S406, the CPU 203 controls the RAM 205 to return from the self-refresh mode to the normal operation mode which allows data read/write accesses. Furthermore, in step S407, the operation frequency of the CPU 203, which was lowered to suppress power consumption, is returned to a normal frequency. In step S408, the LAN controller integrated in the CPU 203 is returned to the normal operation mode in which the controller can receive job data. At the same time, the extension board is returned to the normal operation mode.

Furthermore, in step S409, the controller unit 102, to which power supply is restarted, executes initialization processing and the like in the same manner as the activation timing. After that, the CPU 104 executes processing for establishing the link of the extension I/Fs. After link-establishment, the CPU 104 discriminates in step S410 whether or not the interrupt signal from the RTC 111 is asserted.

If it is discriminated that the interrupt signal from the RTC 111 is asserted, the process advances to step S411 to execute predetermined processing such as the head recovery processing. Then, the CPU 104 issues an interrupt clear instruction to the RTC 111, and the printing apparatus 2 returns to the normal operation mode. On the other hand, if it is discriminated that the interrupt signal from the RTC 111 is not asserted, the CPU 104 determines that this interrupt signal is that from the CPU 203 in response to data reception of the LAN controller, and controls the printing apparatus 2 to return to a normal printable state.

With the aforementioned sequence, regardless of whether the extension board 201 or 301 is connected, the printing apparatus 2 can return from the power-saving mode to the normal operation mode in response to either job data reception by the I/F or an elapse of a predetermined time period.

When the extension board mounts the CPU and RTC like the extension board 201, the power supply control can be implemented even if a battery for the RTC is not equipped. Therefore, the extension board 201 does not require any battery, and a further cost reduction can also be attained by omitting this component. When the extension board 201 is connected, in the power-saving mode, the extension board 201 monitors the timer and reception of print data, lowers the operation frequency of the controller unit 102, and stops power supply to respective units of the apparatus, to which power supply is not required in the power-saving mode. For this reason, the power consumption of the controller unit 102 itself can also be greatly reduced.

Note that in this embodiment, the RTC is disposed independently of the CPU. However, the present invention is not limited to this. Recently, a CPU which integrates an RTC can also implement the same control as described above.

Furthermore, in this embodiment, the interrupt signal from the RTC is output to the CPU with which that RTC can communicate, and at the time of generation of the RTC interrupt, the CPU issues a control instruction to the power supply controller. Alternatively, the interrupt signal of the RTC may be simply used as a power supply restart instruction. In this case, the interrupt signal from the RTC is branched off to the CPU and power supply controller. When the interrupt signal is connected to the CPU to which power supply is stopped, unwanted power consumption and damage of internal elements may occur due to flow-in of currents. Hence, an additional component such as a protection circuit is required.

In this embodiment, since processing is executed at predetermined time intervals when the CPU 104 monitors the interrupt signal from the RTC 111 in the normal operation mode, the interrupt signal from the RTC 207 is kept asserted. Such arrangement is adopted under the assumption that an interrupt clear instruction is issued when the date/time information which is being measured and the interrupt timer setting date/time information are copied from the RTC 111 to the storage area of the RTC 207 upon re-transition to the power-saving mode. However, the present invention is not limited to this, and the interrupt clear instruction to the RTC 207 may be issued together with that to the RTC 111.

Second Embodiment

This embodiment will exemplify a case in which the CPU 203 issues an interrupt clear instruction to the RTC 207 when an interrupt clear instruction is issued to the RTC 111. Especially, this embodiment will exemplify a case in which an operation different from the first embodiment is executed when the interrupt signal from the RTC 111 is not issued to the CPU 104 upon returning to the normal operation mode when the extension board 201 is connected to the printing apparatus 2 in the first embodiment.

In the first embodiment, the case in which the interrupt signal from the RTC 111 is not issued to the CPU 104 is identified as data reception from the LAN 208, and the printing apparatus returns to the normal operation mode without any special processing. In the first embodiment, as described above, the date/time information and interrupt timer setting date/time information of the RTC 111 are copied to the storage area of the RTC 207 before transition to the power-saving mode. For this reason, the date/time information which is being measured might have more or less a time difference. Also, a timing difference in terms of precision may be generated between the RTC and peripheral circuits. For this reason, when a long time period has elapsed until the printing apparatus returns to the normal operation mode, based on the stored timer setting date and time, the printing apparatus might be influenced by these differences. Hence, even when the RTC 207 generates an interrupt signal, the RTC 111 might not generate any interrupt signal in response to this interrupt signal in some cases. Furthermore, one of the RTCs 111 and 207 may break down, or troubles due to the consumed battery 112 may occur. Thus, it is necessary to detect them.

This embodiment can solve the aforementioned problems in the first embodiment, attains precise return processing based on an elapsed date and time, and executes abnormality detection together.

Figure 8:
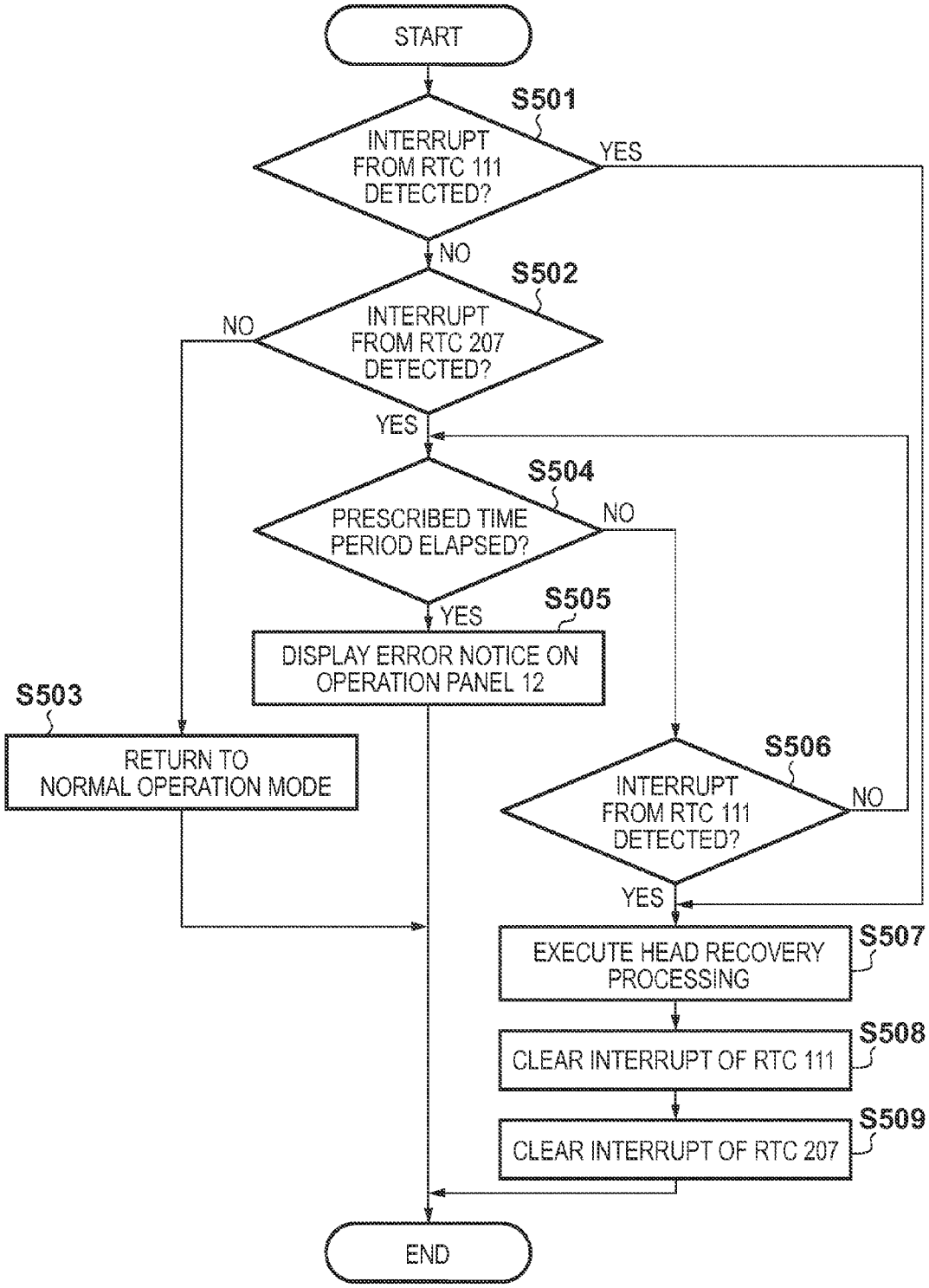
FIG. 8 is a flowchart showing power supply control according to the second embodiment upon returning from the power-saving mode to the normal operation mode when the extension board 201 is connected.

FIG. 8 is a flowchart showing the power supply control upon returning from the power-saving mode to the normal operation mode when the extension board 201 is connected. Note that FIG. 8 includes the discrimination process in step S410 in FIG. 7 as step S501, and the processing will be explained to have this step as a start point.

If the interrupt signal from the RTC 111 to the CPU 104 is detected in step S501, the process jumps to step S507 to execute the head recovery processing, and the CPU 104 issues an interrupt clear instruction to the RTC 111 in step S508, as described in the first embodiment. Also, in step S509, the CPU 104 outputs an interrupt clear request of the RTC 207 to the CPU 203, and upon reception of this request, the CPU 203 issues an interrupt clear instruction to the RTC 207. In this manner, the printing apparatus 2 returns to the normal operation mode, thus ending the processing.

On the other hand, if the interrupt signal from the RTC 111 is not detected in step S501, the process advances to step S502. In step S502, the CPU 104 sends, to the CPU 203, an inquiry about whether or not the interrupt signal from the RTC 207 is detected via the extension I/Fs 113 and 202. If the CPU 203 does not detect any interrupt signal from the RTC 207, the process advances to step S503, and the CPU 104 determines that there is data reception from the LAN 208. Then, the CPU 104 controls the printing apparatus 2 to return to the normal operation mode, thus ending the processing.

On the other hand, if the CPU 203 detects the interrupt signal from the RTC 207 in step S502, the process advances to step S504, and the CPU 104 checks whether or not a prescribed time period has elapsed. If the prescribed time period has not elapsed yet, the process advances to step S506 to wait until the interrupt signal is issued from the RTC 111 for that prescribed time period. If the CPU 104 detects the interrupt signal from the RTC 111 within that prescribed time period, the process advances to step S507 to execute the aforementioned processing, and the printing apparatus 2 returns to the normal operation mode.

On the other hand, if the prescribed time period has elapsed, the process advances to step S505, and the CPU 104 notifies the user of occurrence of an error via the operation panel 12 (error notice) and stops the processing, thereby ending the processing.

Note that the prescribed time period as a waiting time in step S504 may be determined in consideration of, for example, an acceptable difference of date/time information of the RTC. In this embodiment, the elapse of this prescribed time period is determined as an abnormal state due to occurrence of failures and consumption of the battery 112, as described above.

Therefore, according to the aforementioned embodiment, the return processing from the power-saving mode to the normal operation mode can be more precisely executed based on an elapsed date and time, and abnormality detection can be executed together, as compared to the first embodiment.

In the above embodiments, the color printer which adopts the inkjet printing method and performs printing on large print media of A0 and B0 sizes has been exemplified as the printing apparatus. However, the present invention is not limited to this. For example, printing apparatuses and copying machines such as laser beam printers using other printing methods may be used instead, or inkjet printing apparatuses which perform printing on print media of A4 and A3 sizes may be used.

The above embodiments adopt the arrangement in which in the power-saving mode, the control is entrusted on the extension board side, and power supply to the controller unit is stopped. However, the present invention is not limited to this. For example, the present invention is applicable to, for example, an arrangement in which some functions of the controller unit continuously receive power supply.

Furthermore, in the above embodiments, the switch circuit configured by the FET transistor and digital transistor is used as a circuit used for controlling power supply switching. However, the present invention is not limited to this. For example, when the DC-DC converter has an output switching terminal, that terminal may be used.

Moreover, in the above embodiments, one RTC has the battery. However, the present invention is not limited to this. For example, a plurality of RTCs may have batteries. The above embodiments have been described under the assumption that devices of the same type are arranged as the RTCs. However, the present invention is not limited to this. For example, the present invention can be practiced using different types of devices even when they are of different types and handle different kinds of timer information, for example, even when they are compatible or incompatible with days of the week, as long as programs used to convert such differences are prepared to be able to attain their consistency.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2011-019141, filed Jan. 31, 2011, which is hereby incorporated by reference herein in its entirety.

What is claimed is:

1. A printing apparatus comprising:

a power supply control unit configured to control power supply to respective units included in the printing apparatus, from a power supply unit;

a printing unit configured to print at a normal operation mode; and a controller unit, including: an interface unit for connecting to an extension board which includes a communication unit for communicating with an external; a first controller for controlling the printing unit and the power supply control unit; and a first timer, wherein, in a case where the extension board connected via the interface unit has a second controller and second timer and a condition for changing from the normal operation mode to a power saving mode is satisfied, the second controller instructs the second timer to time until the predetermined time period elapses, and instructs the power supply control unit to cause the printing apparatus to change from the normal operation mode to the power-saving mode by stopping supplying power to al least the printing unit, the first controller and the first timer, and in a case where the predetermined time period elapsed since the printing apparatus changed from the normal operation mode to the power-saving mode, the second controller instructs the power supply control unit to resume the power supply, and causes the printing apparatus to return from the power-saving mode to the normal operation mode.

2. The apparatus according to claim 1, wherein the printing apparatus is an inkjet printing apparatus using a printhead, and the first controller performs recovery processing for the printhead in a case where the printing apparatus returns from the power-saving mode to the normal operation mode.

3. The apparatus according to claim 1, wherein the first controller includes a first CPU and a first memory unit, and the second controller includes a second CPU and a second memory unit.

4. The apparatus according to claim 3, wherein in a case where the predetermined time period elapsed since the printing apparatus changed from the normal operation mode to the power-saving mode, the second timer asserts an interrupt signal to the second CPU.

5. The apparatus according to claim 3, wherein, in a case where the predetermined time period elapsed since the printing apparatus changed from the normal operation mode to the power-saving mode, the second timer asserts an interrupt signal to the second CPU, and if the first timer does not assert an interrupt signal to the first CPU, the first CPU waits for detecting the interrupt signal for a predetermined period of time.

6. The apparatus according to claim 5, further comprising a notification unit configured to notify an error in a case where the first CPU has not detected any interrupt signal even after the predetermined period of time elapsed.

7. The apparatus according to claim 1, wherein the power supply unit includes a battery for always supplying power to the first timer.

8. The apparatus according to claim 1, wherein the printing unit includes a battery for always supplying power to the first timer.

9. The apparatus according to claim 1, wherein, in a case where the extension board connected via the interface unit has no processor or timer and a condition for changing from the normal operation mode to the power-saving mode is satisfied, the first controller instructs the first timer to time until a predetermined time period elapses, and instructs the power supply control unit to cause the printing apparatus to change from the normal operation to the power-saving mode by lowering supplying power to the controller unit and the extension board.

10. The apparatus according to claim 9, wherein, in a case where the predetermined time period elapsed since the printing apparatus changed from the normal operation mode to the power-saving mode, the first controller instructs the power supply control unit to resume the power supply, and causes the printing apparatus to return from the power-saving mode to the normal operation mode.

11. A controlling method of a printing apparatus having a power supply control unit configured to control power supply to respective units included in the printing apparatus, from a power supply unit, a printing unit configured to print at a normal operation mode, and a controller unit including an interface unit for connecting to an extension board which includes a communication unit for communicating with an external, a first controller for controlling the printing unit and the power supply control unit, and a first timer, the method comprising:

in a case where the extension board connected via the interface unit has a second controller and second timer and a condition for changing from the normal operation mode to a power-saving mode is required, by the second controller, instructing the second timer to time until the predetermined time period elapses and instructing the power supply control unit to cause the printing apparatus to change from the normal operation mode to the power-saving mode by stopping supplying power to at least the printing unit, the first controller and the first timer unit; and in a case where the predetermined time period elapsed since the printing apparatus changed from the normal operation mode to the power-saving mode, by the second controller, instructing the power supply control unit to resume the power supply, and causing the printing apparatus to return from the power-saving mode to the normal operation mode.

12. The method according to claim 11, wherein the printing apparatus is an inkjet printing apparatus using a printhead, and further comprising performing, by the first controller, recovery processing for the printhead in a case where the printing apparatus returns from the power- saving mode to the normal operation mode.

13. The method according to claim 11, wherein the first controller includes a first CPU and a first memory unit, and the second controller includes a second CPU and a second memory unit.

14. The method according to claim 13, further comprising, in a case where the predetermined time period elapsed since the printing apparatus changed from the normal operation mode to the power-saving mode, asserting by the second timer an interrupt signal to the second CPU.

15. The method according to claim 13, further comprising:

in a case where the predetermined time period elapsed since the printing apparatus changed from the normal operation mode to the power-saving mode, asserting by the second timer an interrupt signal to the second CPU; and if the first timer does not assert an interrupt signal to the first CPU, waiting by the first CPU for detecting the interrupt signal for a predetermined period of time.

16. The method according to claim 15, further comprising notifying an error in a case where the first CPU has not detected any interrupt signal even after the predetermined period of time elapsed.

17. The method according to claim 11, wherein the power supply unit includes a battery for always supplying power to the first timer.

18. The method according to claim 11, wherein the printing unit includes a battery for always supplying power to the first timer.

19. The method according to claim 11, further comprising, in a case where the extension board connected via the interface unit has no processor or timer and a condition for changing from the normal operation mode to the power-saving mode is satisfied, by the first controller, instructing the first timer unit to time until a predetermined time period elapses and instructing the power supply control unit to cause the printing apparatus to change from the normal operation to the power-saving mode by lowering supplying power to the controller unit and the extension board.

20. The method according to claim 19, further comprising, in a case where the predetermined time period elapsed since the printing apparatus changed from the normal operation mode to the power-saving mode, by the first controller, instructing the power supply control unit to resume the power supply and causing the printing apparatus to return from the power-saving mode to the normal operation mode.

* * * * *